US009718667B2

(12) United States Patent
Elliot

(10) Patent No.: US 9,718,667 B2
(45) Date of Patent: Aug. 1, 2017

(54) SYSTEM FOR USE IN HORSEBACK RIDING

(71) Applicant: David Elliot, San Diego, CA (US)

(72) Inventor: David Elliot, San Diego, CA (US)

( * ) Notice: Subject to any disclaimer, the term of this patent is extended or adjusted under 35 U.S.C. 154(b) by 144 days.

(21) Appl. No.: 14/219,219

(22) Filed: Mar. 19, 2014

(65) Prior Publication Data

US 2015/0266716 A1 Sep. 24, 2015

(51) Int. Cl.

| | |
|---|---|
| ***B68C 3/00*** | (2006.01) |
| ***B68C 1/16*** | (2006.01) |
| ***B68C 1/14*** | (2006.01) |
| ***B68C 1/02*** | (2006.01) |
| ***B68C 1/00*** | (2006.01) |

(52) U.S. Cl.

CPC ..... *B68C 3/00* (2013.01); *B68C 1/00* (2013.01); *B68C 1/02* (2013.01); *B68C 1/14* (2013.01); *B68C 1/16* (2013.01); *B68C 2003/005* (2013.01)

(58) Field of Classification Search

CPC ..... B68C 1/16; B68C 3/00; B68C 2003/008; B68C 2003/005; B68C 2003/058; B68C 3/02

USPC ..... 54/47, 49, 23, 46.1

IPC ..... B68C 1/16,3/00, 3/02

See application file for complete search history.

(56) References Cited

U.S. PATENT DOCUMENTS

| | | | | | |
|---|---|---|---|---|---|
| 18,246 | A * | 9/1857 | Neil | B68C 3/02 | 54/49 |
| 199,498 | A * | 1/1878 | Blincoe | B68B 3/00 | 54/47 |
| 509,139 | A * | 11/1893 | Riker et al. | B68C 3/02 | 54/49 |
| 807,000 | A * | 12/1905 | Southworth | B68C 3/02 | 267/70 |
| 1,048,803 | A * | 12/1912 | Bridgforth | B68C 3/02 | 54/49 |
| 2,978,855 | A * | 4/1961 | Horst | B68C 3/00 | 54/47 |
| 4,354,338 | A * | 10/1982 | Martin | B68C 1/16 | 54/47 |
| 4,716,715 | A * | 1/1988 | Johnson | B68C 1/027 | 54/44.5 |
| 5,216,874 | A * | 6/1993 | Farrow | B68C 1/16 | 54/46.1 |
| 5,284,005 | A | 2/1994 | Jacobi | | |
| 5,598,687 | A * | 2/1997 | Hester | B68C 3/00 | 54/47 |
| 5,735,109 | A | 4/1998 | Kojima | | |
| 5,901,531 | A | 5/1999 | Rogers | | |
| 6,298,640 | B1 | 10/2001 | Schneider | | |
| 6,557,328 | B1 * | 5/2003 | Stinnett | B68C 3/00 | 54/46.1 |
| 7,121,068 | B2 | 10/2006 | Van Scoyk | | |
| 7,225,602 | B2 | 6/2007 | Dubourg | | |
| 7,506,493 | B2 | 3/2009 | Zillmer | | |
| 7,526,904 | B2 | 5/2009 | Fuss | | |
| 2004/0168414 | A1 * | 9/2004 | Siddoway | B68C 1/14 | 54/23 |

(Continued)

*Primary Examiner* — Lisa Tsang

(57) ABSTRACT

A system for horseback riding comprising an inverse stirrup which allows a horseback rider to use the top of the rider's foot to resist upward or transverse forces so as to maintain the rider's position on the horse. The inverse stirrup is attached to the horse by a circumferential or semi-circumferential strap passing beneath the horse such as the girth strap, or directly to the saddle, such that the system resists upward displacement of the inverse stirrup.

11 Claims, 6 Drawing Sheets

(56) References Cited

U.S. PATENT DOCUMENTS

| | | | | |
|---|---|---|---|---|
| 2005/0011168 | A1* | 1/2005 | Kirkpatrick | B68C 1/027 54/44.1 |
| 2005/0120684 | A1 | 6/2005 | Sparacino | |
| 2006/0248863 | A1 | 11/2006 | Gorman | |
| 2008/0223008 | A1* | 9/2008 | Ryan | B68C 1/10 54/44.5 |

* cited by examiner

SYSTEM FOR USE IN HORSEBACK RIDING

CROSS-REFERENCES TO RELATED APPLICATIONS

This application claims the benefit of U.S. Prov. Pat. App. Ser. No. 61/802,498, filed Mar. 16, 2013, entitled "INVERSE STIRRUP."

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON COMPACT DISC

Not Applicable.

BACKGROUND

Technical Field of the Invention

The present invention is in the field of horseback riding equipment. More particularly, the present invention is in the field of systems for use in horseback riding that include stirrups which horseback riders contact with their feet.

Description of the Related Art

The contemporary conventional horseback-riding system includes a saddle attached to the horse by means of a girth strap and stirrups which hang from the saddle by means of straps called stirrup leathers, although these straps may be made'out of materials other than leather. This system is the product of many centuries of design evolution, thought to have begun with a single simple leather toe-loop attached to the saddle, used by early barefoot riders to mount the horse, and culminating in the current system.

In the current conventional system, the stirrup typically consists of a rounded oblong metal loop with a flat base. The horseback rider inserts his or her foot into the stirrup and rests the sole of the foot on the upper surface of the flat base of the stirrup. The strap from which the stirrup hangs, called the stirrup leather, transfers to the saddle any downward force exerted by the sole of the rider's foot on the stirrup base.

That system, with stirrups hanging from stirrup leathers, allows the rider to rest his or her feet, to press down in order to resist downward forces, to rise from a seated position in the saddle, and to shift or distribute the rider's weight between the saddle and the rider's feet.

Because in this conventional system the stirrup hangs freely from a strap or straps attached to the saddle, that system can only directly resist force exerted downward through the rider's foot. Such a system is therefore of only limited effectiveness when a rider is subjected to upward or sideward forces, for example when the horse is in a state of upset and bolts, bucks, or rears up.

In addition, horseback riders in mounted sports such as horse-racing and polo must often maintain difficult body positions and control their horses while maneuvering at high speed. Even the most skillful of riders—jockeys and horse-jumping competitors, for example—can sometimes be subjected under these conditions to displacing forces of such magnitude that the rider is unable to avoid being thrown from the horse. And novice riders, especially when learning how to jump obstacles on horseback, are highly susceptible to being thrown from the horse and may be in danger of serious injury thereby, because the horseback riding system they use provides little or no means to resist the associated upward and transverse forces in instances of rapid acceleration or deceleration.

Related art discloses various types of proposed safety saddles and safety stirrups. Information relevant to attempts to address the problem of horseback rider safety and stability can be found in U.S. Pat. Nos. 5,735,109, 5,901,531, 6,298,640, 5,284,005, 7,225,602, 7,526,904, and 7,506,493, 7,121,068, and U.S. Application Patent Nos. 20060248863 and 20050120684. However, each of these references suffers from one or more of the disadvantages that the disclosed invention either provides no means to resist upward displacing forces, cannot flexibly be used by the rider to resist upward displacing forces while in customary riding positions, or interferes with the rider's normal ability to stand or move in the saddle or to dismount. None of these systems provide the benefits of the herein-described invention.

Hence, there is a need for a new system that a horseback rider can use to resist vertical and transverse displacing forces and maintain the rider's position on the horse under difficult conditions.

SUMMARY

The present invention is a system for use in horseback riding that includes an inverse stirrup which is contacted by the upper surface of the rider's foot, and which is attached to the horse's saddle or attached to a strap passing underneath the horse such as the saddle girth strap such that the system restricts upward movement of the inverse stirrup.

A conventional stirrup hangs freely from stirrup leathers and only resists forces transmitted downward through the bottom of the rider's foot. An "inverse stirrup" as that term is defined and used herein is a stirrup that is fastened to the horse's tack such that the inverse stirrup resists upward displacement from forces transmitted through the upper surface of the rider's foot.

The horse rider may therefore use the system of the present invention to resist upward or transverse forces that could otherwise dislodge the rider from the saddle or eject the rider from the horse. Systems for modifying an existing conventional stirrup to obtain similar benefit are also disclosed.

As the prior art fails to teach a system, a stirrup, or a modification thereof capable of being used by the rider in this manner to resist upward displacing forces, this disclosure teaches advantages and benefits distinguished over the prior art.

These and other aspects, advantages, and features of the invention will become better understood from the description of the invention and appended claims, considered along with the accompanying drawings.

BRIEF DESCRIPTION OF THE DRAWINGS

Illustrated in the accompanying drawings is at least one of the best mode embodiments of the present invention.

FIG. 6 shows a rider's foot first inserted through a conventional stirrup and then inserted into an inverse stirrup of the system of the present invention, attached to a strap that passes underneath the horse;

DETAILED DESCRIPTION

Figure 1:
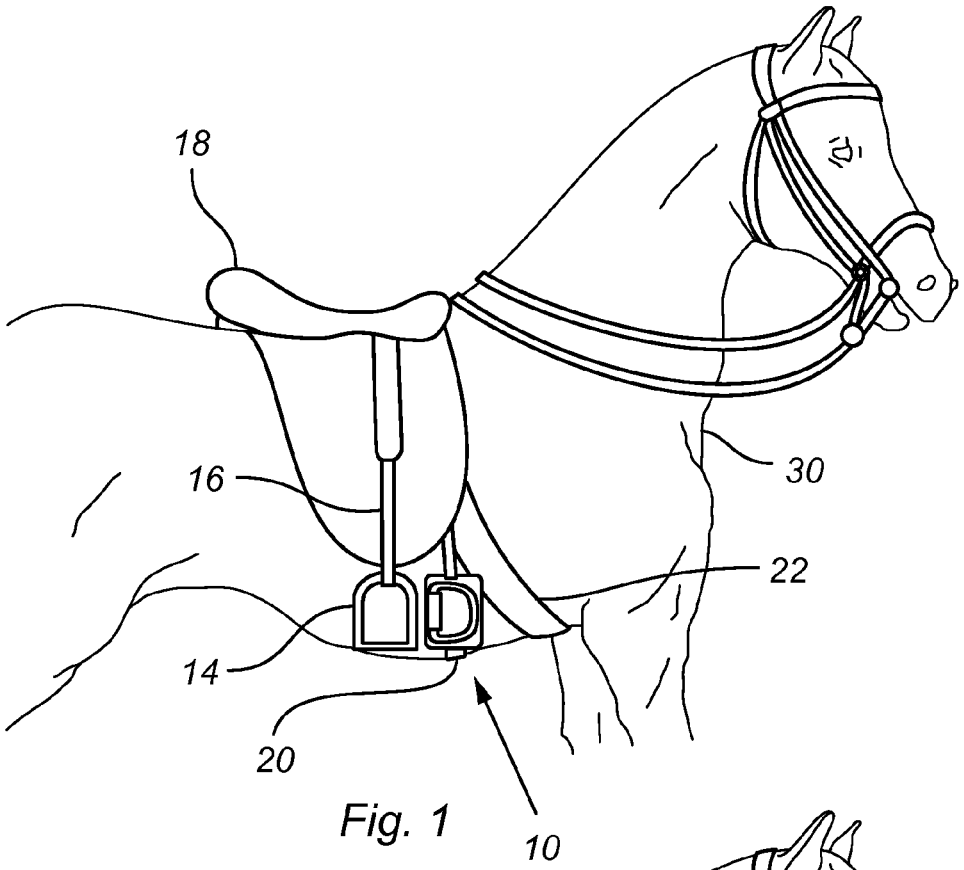
FIG. 1 is a side view of one embodiment of the present invention, showing an inverse stirrup attached to a strap passing underneath the horse, the inverse stirrup as shown located next to a conventional stirrup that hangs from a stirrup leather attached to the saddle.

The above-described figures illustrate the present invention and its method of use in at least one of its preferred, best mode embodiments, as further defined in detail in the following description.

The present invention is a system for horseback riding that comprises an inverse stirrup attached to the horse's tack using a fastener such that the system will resist upward displacing forces on, and upward movement of, the stirrup.

In general equestrian usage, the word "tack" is a collective noun that may be used to refer to any equipment that is placed on the horse to facilitate riding.

For purposes of this patent application, and as used herein, the word "tack" is defined specifically as the more limited group consisting of:

1. the saddle;
2. a strap such as the girth strap that partially encircles the horse passing beneath the horse's underside and is attached to the saddle;
3. a strap such as a surcingle or overgirth that fully encircles the horse and need not be attached to the saddle.

In different embodiments of the present invention, the inverse stirrup therefore may be attached to the girth strap, or to another strap that passes circumferentially below the horse and partially or fully encircles the horse, or may be attached directly to the saddle.

The present invention disclosed therefore allows the rider to use the tops of the feet to resist upward or sideward forces acting on the rider. This system allows the rider to maintain position, stability, and control while mounted on horseback, when subjected to forces that could otherwise displace the rider or eject the rider from the horse.

Referring now to the system of the present invention in more detail, in FIG. 1 to FIG. 7 and FIGS. 9 to 10 there is shown a system incorporating an inverse stirrup 10, 12, which the horseback rider contacts with the upper surface of his or her foot to resist upward forces on the rider. In different embodiments, the inverse stirrup may be attached to the horse's tack 18, 20, 22 by a fastener 46, or the stirrup 10, 12 may be first attached to a base 32 by a fastener 26, the base 32 then attached to the horse's tack 18, 20, 22 by a fastener 46, described further below.

FIGS. 1, 2, 6, and 10 show in addition a conventional stirrup 14, which hangs from a stirrup leather 16 attached to the saddle 18; these elements of the conventional horseback riding system are shown for contrast and for ease of visualizing the system of the present invention in use. The conventional stirrup 14 and stirrup leather 16 are not part of the system of the present invention.

Turning to FIG. 1, FIG. 1 shows a stirrup 10 of the system of the present invention attached to a strap 20 passing underneath the horse 30 that is affixed to the saddle 18. FIG. 1 shows the stirrup 10 of the system of the present invention and its preferred location with respect to a conventional stirrup 14 when the conventional stirrup 14 and the system of the present invention are used simultaneously.

Figure 2:
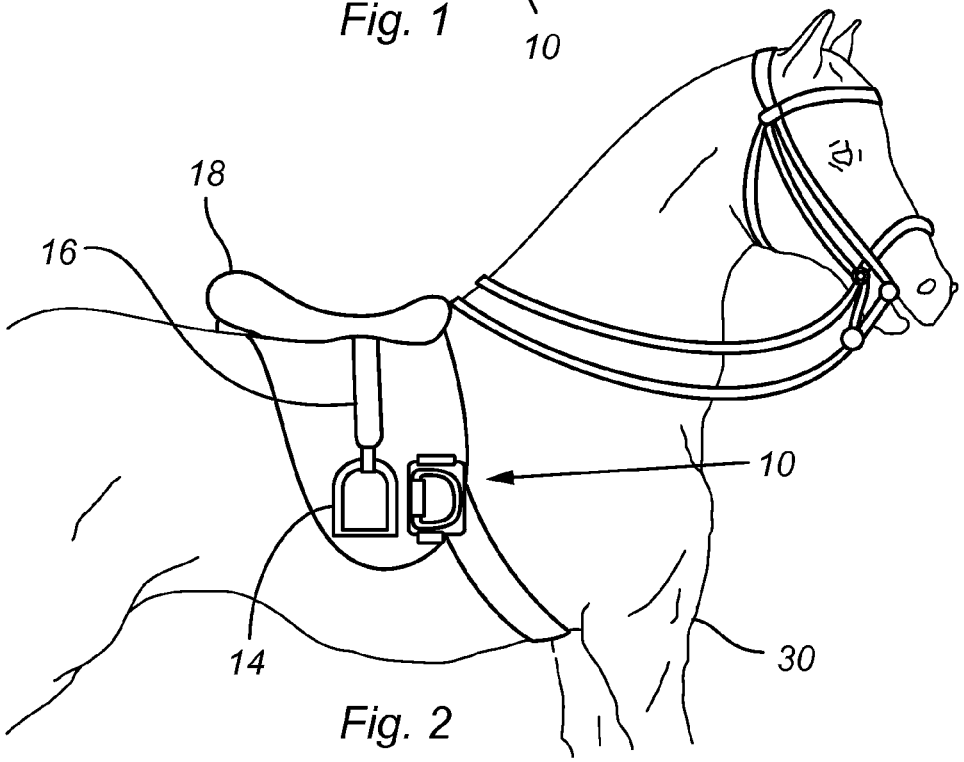
FIG. 2 is a side view of one embodiment of the present invention, in which the inverse stirrup is attached directly on the saddle, the inverse stirrup located next to a conventional stirrup hanging from a stirrup leather attached to the saddle.

FIG. 2 shows the stirrup 10 of the system of the present invention attached directly to the horse's saddle 18, illustrating the preferred orientation with respect to a conventional stirrup 14 when the stirrup 10 is attached in this manner.

Figure 3A:
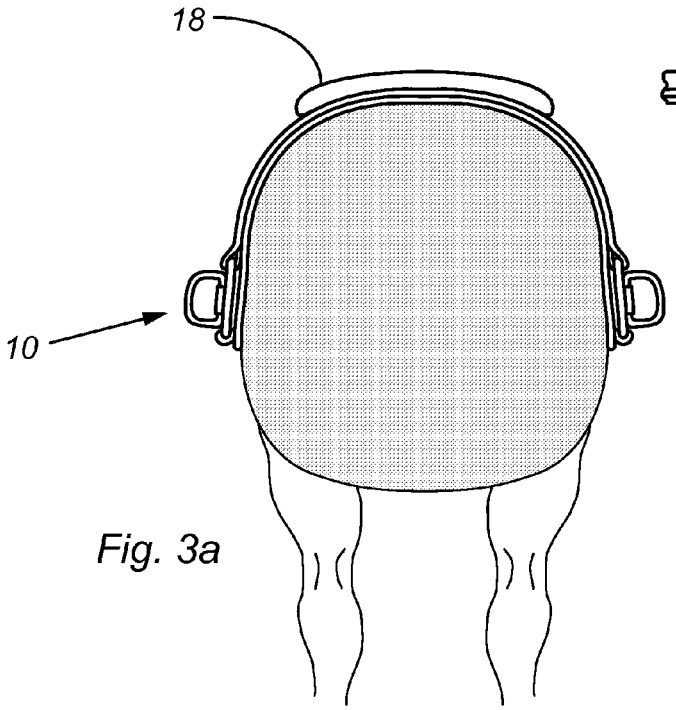
FIG. 3*a* is a section view of one embodiment of the present invention, showing the inverse stirrup attached directly to the horse's saddle.

FIG. 3*a* shows one version of the stirrup 10 of the system of the present invention attached directly to the saddle 18.

Figure 3B:
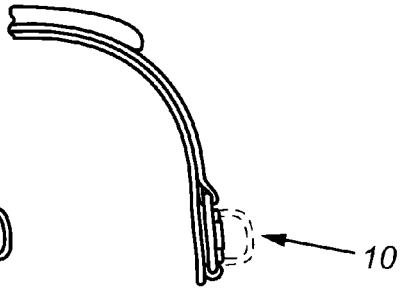
FIG. 3*b* is a section view of one embodiment of the present invention, showing the inverse stirrup of FIG. 3*a* pivoted to lie flat against the horse when not in use.

Turning to FIG. 3*b*, in one embodiment the stirrup 10, 12, may pivot so that the stirrup can lay flat against the side of the horse 30 when not in use, and pivot outward to an angle approximately perpendicular to the side of the horse 30 while in use by the rider.

Figure 4A:
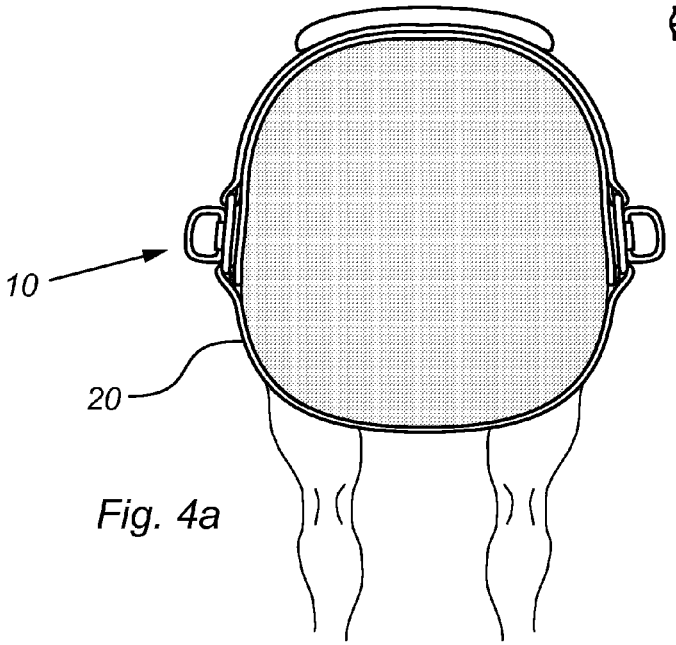
FIG. 4*a* is a section view of one embodiment of the present invention, showing the inverse stirrup attached to a strap passing underneath the horse.

FIG. 4*a* shows one embodiment of the stirrup of the present invention 10 attached to a strap 20 passing underneath the horse.

Figure 4B:
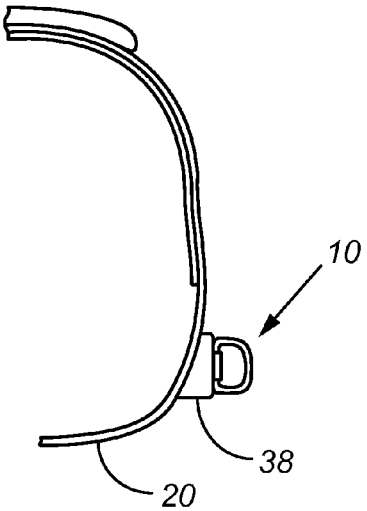
FIG. 4*b* is a section view of one embodiment of the present invention, showing the inverse stirrup of FIG. 4*a* attached to a spacer or stand-off which is attached to a strap passing underneath the horse.

Turning to FIG. 4*b*, the stirrup 10, 12 may also be offset a certain distance from the horse's body by means of a spacer 38 that increases the distance between the horse and the stirrup.

The stirrup 10, 12 is preferably made of a rigid structural material such as aluminum, steel, titanium, or other metal or metals or metal alloys, or plastic, fiber-reinforced plastic, carbon fiber composite, or other durable material.

Figure 5:
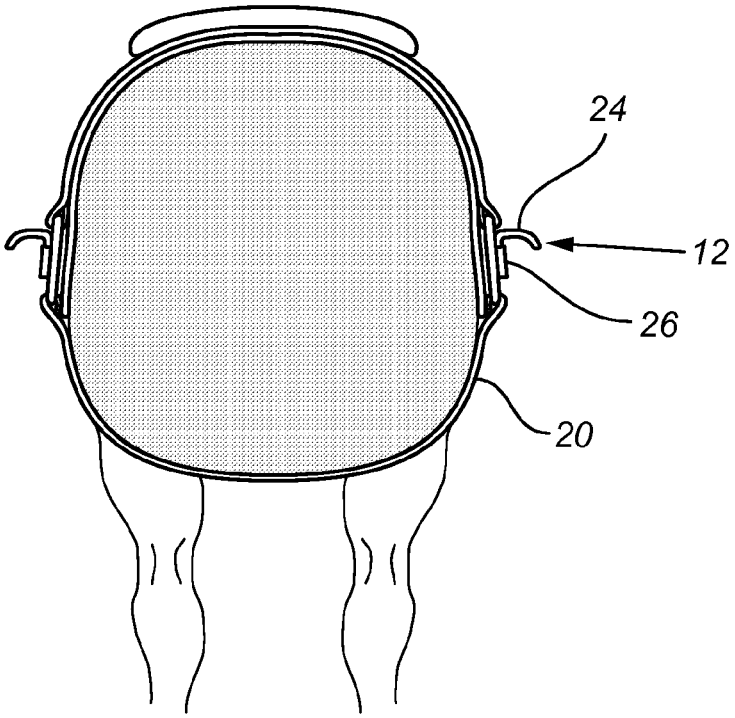
FIG. 5 is a section view of one embodiment of the present invention in which the rigid elements of the inverse stirrup form an open shape and the horizontal element of the inverse stirrup is free at one end.

In embodiments of the present invention, rigid structural elements of the inverse stirrup may be formed in either a closed or an open shape. In open-shape embodiments, as shown in FIG. 5, the horizontal element 24 of the stirrup 12 is free at one end. In closed-shape embodiments, as shown in FIGS. 1, 2, 3, 4, 6, and 7, the stirrup 10 is formed in a closed shape which may be circular, ovoid, squared-off, or may resemble a capital "D" as shown in FIGS. 1, 2, 3, 4, 6, and 7.

In some embodiments, as shown in FIG. 5, the stirrup 12 is formed in an open shape which in this figure resembles an upside-down "L" shape, where the vertical element 26 is attached to the saddle 18, girth 22, or other strap 20, and the rider places his or her foot below the horizontal element 24. The horizontal element 24 may, among many possibilities, be straight, or may take the form of roughly a truncated circle or arc which may be greater or less than or equal to a semi-circle, or may be formed in other shapes so as to receive the top surface of the rider's foot.

Figure 6:
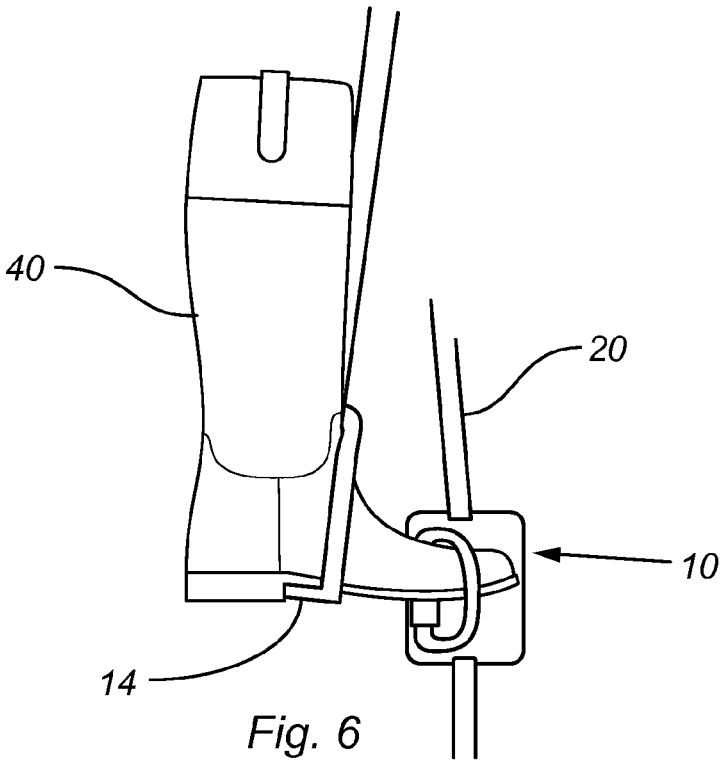
FIG. 6 is a side view of one embodiment of the present invention showing use of the present invention simultaneously with a conventional stirrup.

FIG. 6 shows an embodiment of the system of the present invention in use simultaneously with a conventional horseback riding system. FIG. 6 shows a horseback rider's foot 40 inserted first through a conventional stirrup 14, then inserted into an inverse stirrup 10 of the system of the present invention, which stirrup 10 is attached to a strap 20, 22.

Figure 7:
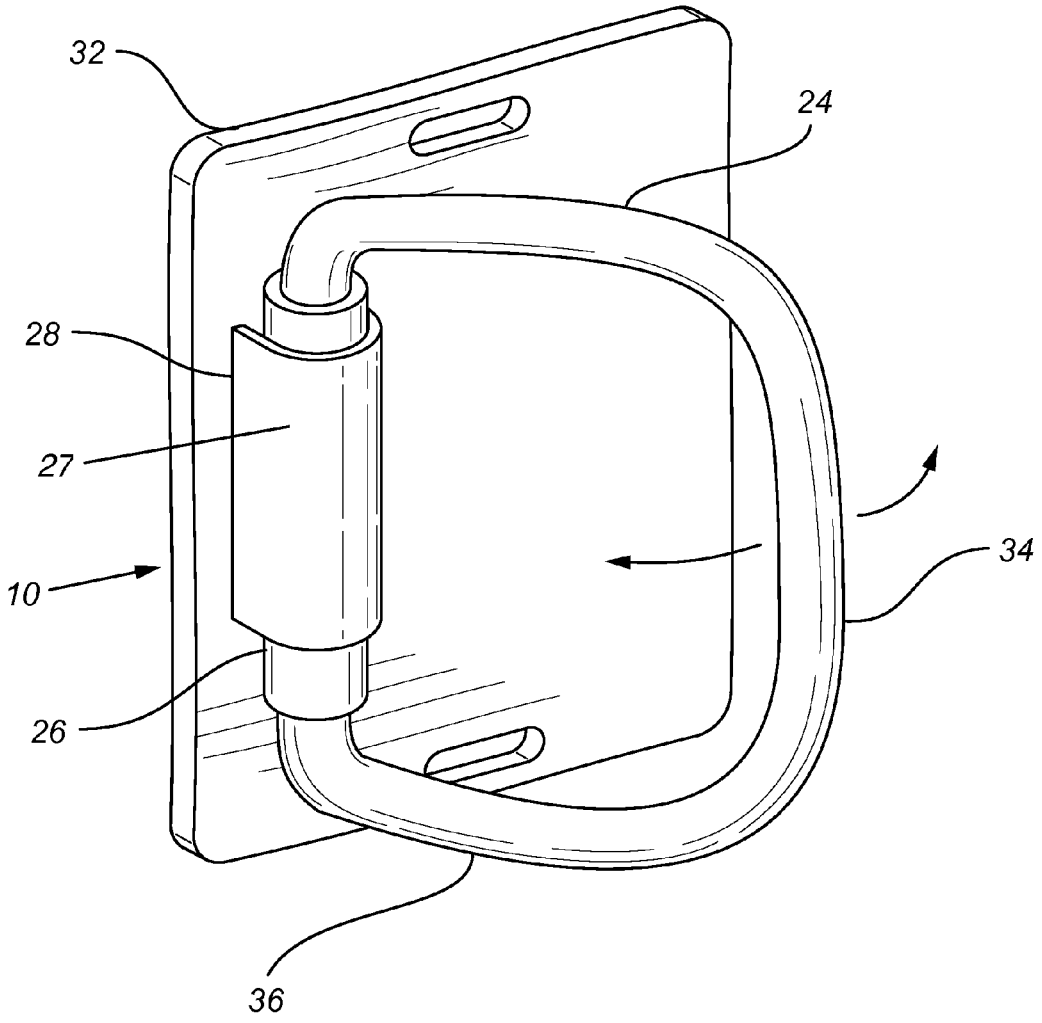
FIG. 7 is a perspective view of one embodiment of the present invention, showing an inverse stirrup mounted on a base.

Turning to FIG. 7, FIG. 7 shows one version of the inverse stirrup 10 of the system of the present invention, showing the inverse stirrup 10 having a rigid substantially horizontal element 24. In this embodiment, the inverse stirrup 10 in addition to the horizontal element 24 also comprises a roughly vertical element 26 connected to the horizontal element 24, a fastener 28, and a base 32 which may be used to attach the stirrup 10 to the horse's tack. An embodiment of the present invention may comprise in addition a second roughly vertical side element 34 and a lower element 36, the horizontal element 24, first and second roughly vertical elements 26, 34, and lower element 36 join to form a loop 10.

FIG. 7 further shows the inverse stirrup 10 of the present invention attached to a rigid, flexible, or semi-flexible base 32 using a fastener 28. The base 32 is then attached to the saddle 18 or to a strap 20, 22 passing underneath the horse, as shown in FIG. 9.

Figure 8:
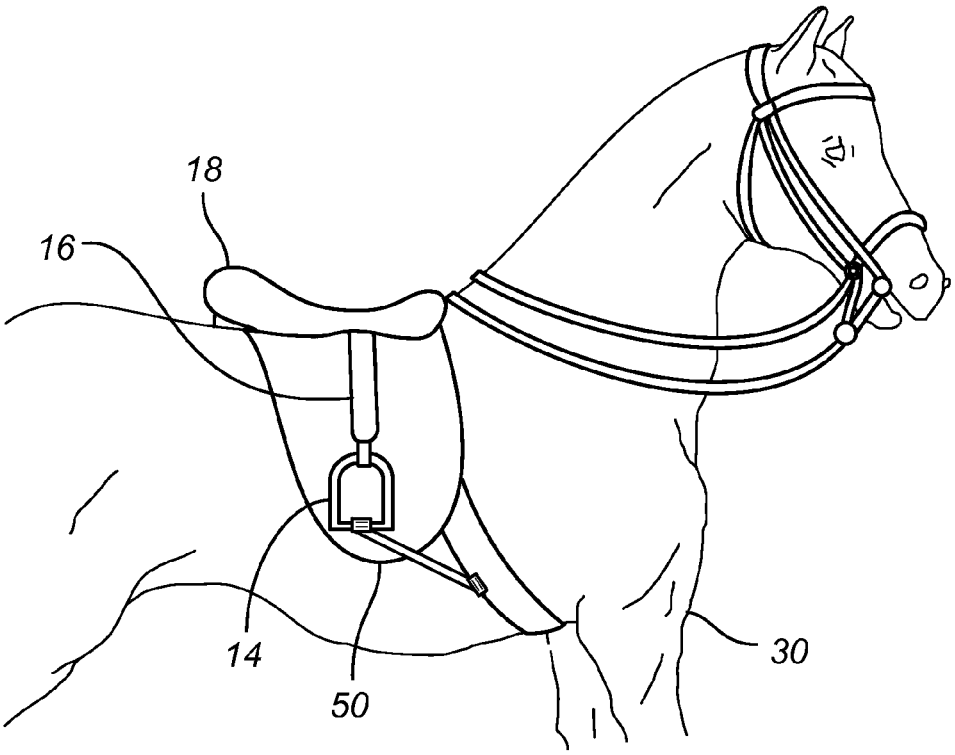
FIG. 8 is a side view of one embodiment of the present invention showing a conventional stirrup modified by means of an element attaching the conventional stirrup to a strap passing underneath the horse.

Further, as shown in FIG. 8, a restraining element 50 may be employed to attach an existing conventional stirrup 14 to a strap 20, 22 passing underneath the horse, or to the saddle 18, in a manner such that the existing stirrup 14 can partially resist upward displacing forces, thereby enabling the rider to resist ejection from the horse.

Figure 9:
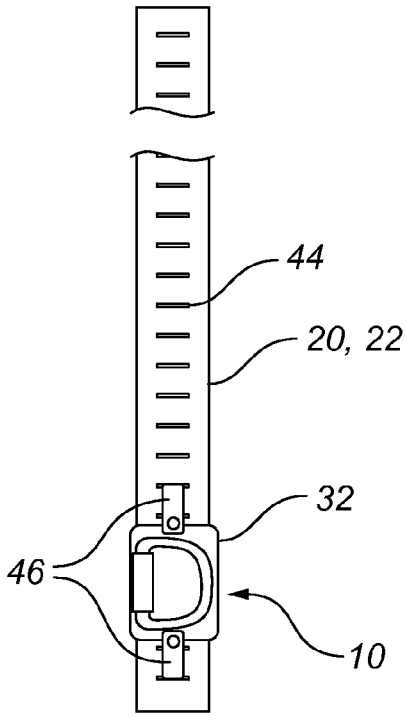
FIG. 9 is a side view of one embodiment of the present invention showing an inverse stirrup attached repositionably to a strap that passes underneath the horse, the fastener of the stirrup adapted to cooperate with fastening means on the strap.
Figure 10:
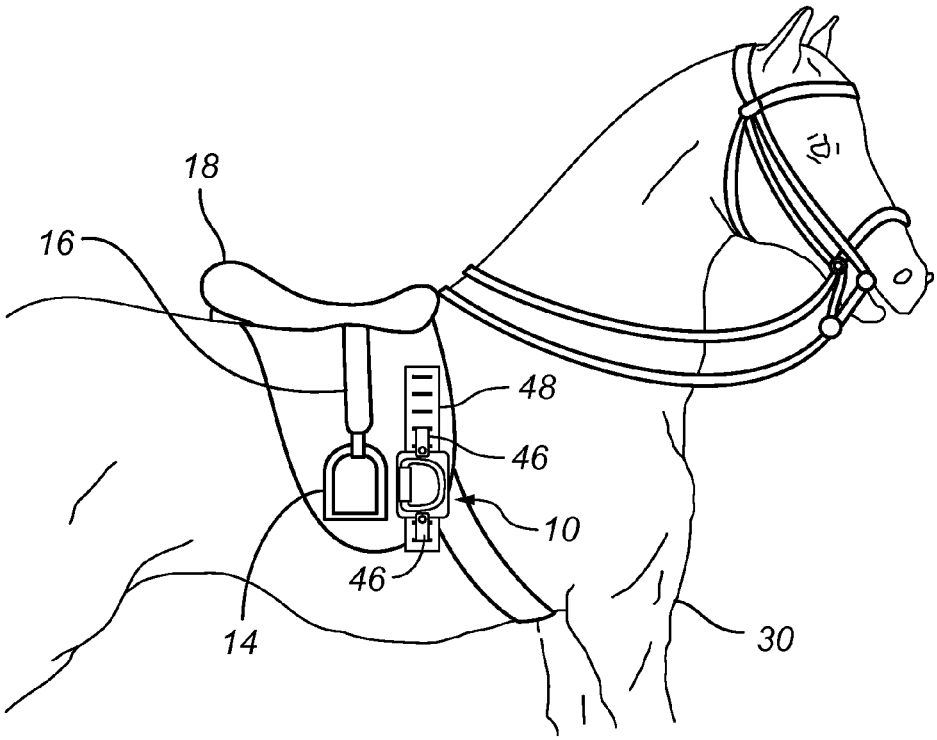
FIG. 10 is a side view of one embodiment of the present invention showing an inverse stirrup attached repositionably to the saddle, the fastener of the stirrup adapted to cooperate with fastening means on the saddle.

Turning to FIGS. 9 and 10, the fastener 46 attaching the inverse stirrup 10, 12 to the tack 18, 20, 22 may be adapted to cooperate with fastening means 44, 48 on the tack.

FIG. 9 shows an embodiment of the system of the present invention in which the stirrup 10 is mounted on a base 32, the base 32 attached to a circumferential or partially circumferential strap 20, 22 by a fastener 46, the fastener 46 adapted to cooperate with fastening means 44 on the strap 20, 22 to attach the stirrup 10 repositionably on the strap 20, 22 to allow the height of the stirrup 10 to be adjusted relative to the horseback rider.

FIG. 10 shows an embodiment of the system of the present invention in which the stirrup 10 is attached to the saddle 18 by a fastener 46, the fastener 46 adapted to cooperate with fastening means 48 on the saddle to attach the stirrup 10 repositionably on the saddle 18 to allow the height of the stirrup 10 on the saddle 18 to be adjusted relative to the horseback rider.

Numerous types of fasteners 46 well-known to persons having ordinary skill in the art may be used to attach the inverse stirrup 10, 12, of the system of the present invention to the saddle 18 or to a strap 20, 22, or to an interposed base 32. Numerous types of fasteners 28 well-known to persons having ordinary skill in the art may be used to attach the inverse stirrup 10, 12, of the system of the present invention to the base 32.

The fastener 46 shown in FIG. 9 and FIG. 10, attaching the inverse stirrup 10 to the tack, with or without an interposed base 32, and the fastener 28 shown in FIG. 7 attaching the inverse stirrup 10 to a base 32, may be one or more chosen from the following, individually or in combination, or other fastener or fasteners presently existing or developed in the future that performs the same or similar functions:

adhesive, bolt, batten, buckle, button, captive fastener, clamp, clasp, cleko, clip, flange, grommet, hasp, latch, loop, pin, retaining ring, rivet, rod, shackle, snap fastener, staple, stitch, strap, perforated strap, threaded fastener, nut, tie.

In typical use, one of the presently described inverse stirrups 10, 12 of the system of the present invention is located on each of the two sides of a horse to allow the rider to use both feet to resist upward or transverse displacing forces.

Conventional stirrups and the systems incorporating them are designed to resist downward forces imparted by the rider's foot; the disclosed system of the present invention serves the inverse function: it resists upward forces. In conventional horseback riding systems, the stirrups are attached to the horse by means of straps called stirrup leathers which hang freely from the saddle. Prior art systems are therefore not capable of resisting upward forces as the stirrups of those systems are not otherwise attached to the saddle or to the horse.

Compared to the prior art systems and stirrups, the system according to the present invention has substantial advantages. The system according to the present invention provides a substantial benefit to the rider's ability to resist displacing forces and maintain position on the horse.

A prior art search teaches a variety of horseback riding systems and stirrups of various designs and structures, However, the prior art fails to teach a system or stirrup that can be used by the rider effectively to resist upward or transverse displacing forces. The present disclosure distinguishes over the prior art providing heretofore unknown advantages as described in the foregoing description.

The innovations described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are also meant to include not only the combination of elements which are literally set forth, but all equivalent structure, material or acts for performing substantially the same function in substantially the same way to obtain substantially the same result. In this sense it is therefore contemplated that an equivalent substitution of one, two, or more elements may be made for any one of the elements described and its various embodiments or that a single element may be substituted for two or more elements in a claim.

Those having ordinary skill in the art may be able to make alterations and modifications to what is described herein without departing from the spirit and scope of the present invention. The description included herein should not be taken therefore as a limitation on the scope of the present invention or method of use.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

Although this invention has been disclosed in the context of certain preferred embodiments and examples, it therefore will be understood by those skilled in the art that the present invention extends beyond the specifically disclosed embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

I claim:

1. A system for use in horseback riding, comprising:

a. an inverse stirrup comprising i. a rigid, substantially horizontal element having a proximal end and a distal end, wherein the distal end is free, and wherein the substantially horizontal element receives an upper surface of a horseback rider's foot; and b. a fastener attached to the proximal end of the substantially horizontal element, wherein the fastener attaches the substantially horizontal element to an item of a horse's tack, wherein the tack is defined as a strap that partially encircles an underside of the horse and which is attached to a saddle, wherein the strap is positioned forward of a conventional stirrup, the conventional stirrup being positioned rearward of, and separate from, the inverse stirrup, wherein the distal end protrudes from the tack substantially perpendicular to a long axis of the horse when the inverse stirrup is in use, and wherein the fastener restricts displacement of the substantially horizontal element upward.

2. The system of claim 1, in which the inverse stirrup is fastened to the saddle.

3. The system of claim 1, in which the inverse stirrup is fastened to the strap, wherein the strap has two ends, wherein each of the two ends of the strap are attached to the saddle on opposite sides of the horse.

4. The system of claim 1, further comprising a rigid substantially vertical element, the substantially horizontal element of the inverse stirrup connected at one end to the substantially vertical element, the substantially vertical element projecting from the end of the substantially horizontal element, the vertical element connected to a fastener, the fastener attaching the inverse stirrup to the horse's tack.

5. The system of claim 1, further comprising a second rigid element, the substantially horizontal element of the inverse stirrup connected at the proximal end to the second rigid element, the second rigid element projecting at an angle other than a right angle to the substantially horizontal element, the second rigid element connected to a fastener, the fastener attaching the inverse stirrup to the horse's tack, the angle of the second rigid element selected to conform to the shape of the horse's body at a location where the inverse stirrup is attached to the tack.

6. The system of claim 1, further comprising a second rigid element, the substantially horizontal element of the inverse stirrup connected at the proximal end to the second rigid element, the second rigid element connected to a fastener, the fastener attaching the inverse stirrup to the horse's tack, the second rigid element projecting from the proximal end of the substantially horizontal element, the second rigid element formed in a curved shape, a radius of the curved shape of the second rigid element selected to conform to the shape of the underside of the horse's body at a location where the inverse stirrup is attached to the tack.

7. The system of claim 1, in which the fastener attached to the inverse stirrup is a hinge mechanism disposed generally perpendicular to the substantially horizontal element, wherein the substantially horizontal element is bent between the proximal end and the distal end, wherein the proximal end is disposed within the hinge mechanism, wherein the hinge mechanism enables the proximal end of the substantially horizontal element to pivot about a vertical axis such that the substantially horizontal element can lie flat against the tack when not in use by the rider.

8. The system of claim 7, wherein a spacer element is interposed between the inverse stirrup and the tack, the spacer element increasing a distance between the tack and the inverse stirrup.

9. The system of claim 1, in which the fastener attached to the inverse stirrup is adapted to cooperate with a second fastener, the second fastener located on the horse's tack.

10. The system of claim 9, in which the fastener and the second fastener are adapted to allow the inverse stirrup to be fastened repositionably to the tack such that a location of the inverse stirrup on the tack is adjustable.

11. The system of claim 10, in which the location of the inverse stirrup on the tack is adjustable in a vertical direction to vary a height of the stirrup relative to the horseback rider.

* * * * *